US007625147B2

(12) United States Patent
Sakaino et al.

(10) Patent No.: US 7,625,147 B2
(45) Date of Patent: Dec. 1, 2009

(54) PRINTER

(75) Inventors: Tsuyoshi Sakaino, Higashikurume (JP); Sumio Miura, Isehara (JP)

(73) Assignee: Citizen Holdings Co., Ltd., Tokyo (JP)

( * ) Notice: Subject to any disclaimer, the term of this patent is extended or adjusted under 35 U.S.C. 154(b) by 672 days.

(21) Appl. No.: 11/364,187

(22) Filed: Mar. 1, 2006

(65) Prior Publication Data

US 2007/0009305 A1 Jan. 11, 2007

(30) Foreign Application Priority Data

Jun. 30, 2005 (JP) ..... 2005-193204

(51) Int. Cl.
*B41J 11/00* (2006.01)
*B41J 29/00* (2006.01)

(52) U.S. Cl. ..... 400/621; 400/692

(58) Field of Classification Search ..... 400/621, 400/692

See application file for complete search history.

(56) References Cited

U.S. PATENT DOCUMENTS

| | | | | |
|---|---|---|---|---|
| 5,230,576 | A * | 7/1993 | Sone | 400/649 |
| 5,302,037 | A * | 4/1994 | Schoendienst et al. | 400/586 |
| 5,320,437 | A * | 6/1994 | Malke et al. | 400/605 |
| 5,528,278 | A * | 6/1996 | Takizawa et al. | 347/218 |
| 6,270,270 | B2 * | 8/2001 | Koshi et al. | 400/621 |
| 6,474,883 | B1 * | 11/2002 | Kawakami et al. | 400/613 |

FOREIGN PATENT DOCUMENTS

| | | |
|---|---|---|
| JP | 2002-154719 | 5/2002 |

* cited by examiner

*Primary Examiner*—Anthony H. Nguyen
(74) *Attorney, Agent, or Firm*—Smith, Gambrell & Russell, LLP

(57) ABSTRACT

In a printer for printing a rolled printing paper, a front panel is attached to a frame that houses a print unit and a paper holder unit. When the front panel is opened, the print unit and the paper holder unit project on the front side of the frame in association with the action of the front panel.

8 Claims, 14 Drawing Sheets

PRINTER

BACKGROUND OF THE INVENTION

1. Field of the Invention

The present invention relates to a printer in which printing paper can be loaded and replaced with ease.

2. Description of the Related Art

Some known printers are incorporated in various in- and outdoor vending machines and the like and used to issue recorded papers, receipts, tickets, etc. One such printer is described in Japanese Patent Application Laid-Open No. 2002-154719. This conventional printer will now be described with reference to FIGS. 15 and 16.

In replacing a printing paper 150 with a new one, the upper end portion of a unit mounting section 144*b* that forms a front surface of a body bracket 144 shown in FIG. 15 is pulled in the direction indicated by arrow P (counterclockwise direction). Thereupon, the body bracket 144 is swung around a pivot shaft 148 and moved to the position of FIG. 16. When the body bracket 144 is in the state of FIG. 16, holding members 151 for a rolled paper 150 mounted on a rolled paper mounting section 144*a* that constitutes the bottom of the body bracket 144 is situated on the upper front side, while an insertion slot 152 for the rolled paper 150 is situated on the lower front side.

In this state, the used rolled paper 150 is disengaged from the holding members 151, and a new rolled paper 150 is mounted on the holding members 151. The leading end portion of the paper 150 is drawn out and inserted into the insertion slot 152 of the unit mounting section 144*b*. Then, it passes through a print control unit 145 and discharged to the outside through its outlet 153.

Thereafter, the body bracket 144 is swung in the direction indicated by arrow Q (clockwise direction) and restored to its original position (FIG. 15). Subsequently, a feed mechanism is operated to cause the leading end portion of the rolled paper 150 to project a suitable length from the outlet 153, whereupon printing is enabled.

Replacing the rolled paper 150 is very hard when the body bracket 144 of the printer is in the state of FIG. 15. If the bracket 144 is swung counterclockwise around the pivot shaft 148, as shown in FIG. 16, however, the holding members 151 are situated on the upper front side, and the insertion slot 152 for the rolled paper 150 is situated on the lower front side, so that the replacement of the paper 150 is easy.

Since the print control unit 145 is attached to the front of the unit mounting section 144*b*, it is susceptible to external adverse effects, such as external damage, exposure to dust, etc. Further, no receiving members underlie the holding members 151. If the rolled paper 150 fails to be properly mounted on the holding members 151, therefore, it naturally falls and cannot be easily mounted again. In causing the rolled paper 150 to pass through the print control unit 145, furthermore, the leading end portion of the paper 150 is inserted into the insertion slot 152 in the unit mounting section 144*b*. Inevitably, therefore, the rolled paper cannot be set in the print control unit 145 with ease.

SUMMARY OF THE INVENTION

The present invention relates a printer for printing a rolled printing paper.

A printer according to a first aspect of the present invention comprises a frame; a front panel swingably attached to and supported on the frame; a print unit for printing the rolled printing paper, housed in the frame and configured to move toward the front of the frame as the front panel is opened; and a paper holder unit for holding the rolled printing paper, housed in the frame and configured to move toward the front of the frame as the front panel is opened.

The print unit may be attached to a rear surface of the front panel, and the paper holder unit is mounted for longitudinal movement in the frame and coupled to the front panel by a link.

A paper cutting unit for cutting the printed paper may be attached to the rear surface of the front panel.

The paper holder unit may be formed of a bottom plate and side plates and configured to be loaded with the printing paper from above. Further, the frame may have a top opening through which the printing paper is inserted from above and loaded into the paper holder unit. Furthermore, the front panel may be provided with a paper exit through which the printed paper is discharged, and a paper end portion of the printing paper is delivered to the paper exit through the paper cutting unit as the paper end portion is inserted into the print unit from above with the front panel open.

The printing paper may be loaded into the paper holder unit when the front panel is fully opened. The side plates of the paper holder unit may be formed individually having paper supporting shaft locking claws, and the paper supporting shafts are configured to be attached and detached by deforming the locking claws.

The paper holder unit may configured to be mounted with a plurality of paper supporting shafts having different diameters.

A printer according to a second aspect of the present invention comprises: a frame having a top opening; a front panel swingably attached to a front surface of the frame and having a paper exit through which the printed paper is discharged; a print unit attached to the front panel and configured to print the printing paper; a paper cutting unit attached to the front panel and configured to cut the printed paper; a paper holder unit for holding the printing paper, mounted for longitudinal movement in the frame and coupled to the front panel by a link; and a control circuit unit for controlling the print unit and the paper cutting unit; wherein the control circuit unit has an adjusting element configured to be operated through the top opening of the frame when the front panel is opened halfway.

The adjusting element may be a DIP switch.

A base plate is fixedly attached to the frame, a slide plate is mounted on the base plate for longitudinal movement with respect to the base plate, and further the paper holder unit is mounted on this slide plate for longitudinal movement with respect to the slide plate; a base plate opening is formed in the base plate so as to face the adjusting element; a slide plate opening is formed in the slide plate so that the slide plate opening faces the base plate opening of the base plate when the slide plate moves to reach a predetermined position; and the base plate opening, slide plate opening, and paper holder bottom opening are moved to a position where these openings are aligned one another, thereby allowing the adjusting element to be operated when the front panel is opened halfway.

According to the present invention arranged in this manner, there may be provided a printer in which the printing paper can be loaded and replaced with ease and the control circuit unit can be protected against external adverse effects, such as external damage, exposure to dust, etc.

BRIEF DESCRIPTION OF THE DRAWINGS

The above and other objects and features of the present invention will be apparent from the ensuing description of embodiments with reference to the accompanying drawings, in which.

DETAILED DESCRIPTION OF THE PREFERRED EMBODIMENTS

A printer according to the present invention prints and discharges a rolled printing paper. It comprises a frame, front panel, print unit, paper cutting unit, and paper holder unit. The frame partially covers the bottom, side, rear, and top surfaces of the printer. The front panel is swingably attached to the front face of the frame and has a paper exit through which the printed paper is discharged. The print unit is attached to the rear surface of the front panel and serves to print the printing paper. The paper cutting unit is attached to the rear surface of the front panel and serves to cut the printed paper. The paper holder unit is mounted for longitudinal movement in the frame and coupled to the front panel by a link, serving to hold the printing paper. If the front panel is opened, the print unit, paper cutting unit, and paper holder unit get out of the frame through its front surface.

The paper holder unit is formed of a bottom plate and side plates such that the printing paper can be loaded from above. The frame is provided with a top opening through which the printing paper is loaded into the paper holder unit. Thus, the printing paper can be loaded into the paper holder unit from above the frame. If the front panel is fully opened, moreover, the printing paper can be loaded into the paper holder unit through the front of the printer.

Figure 1:
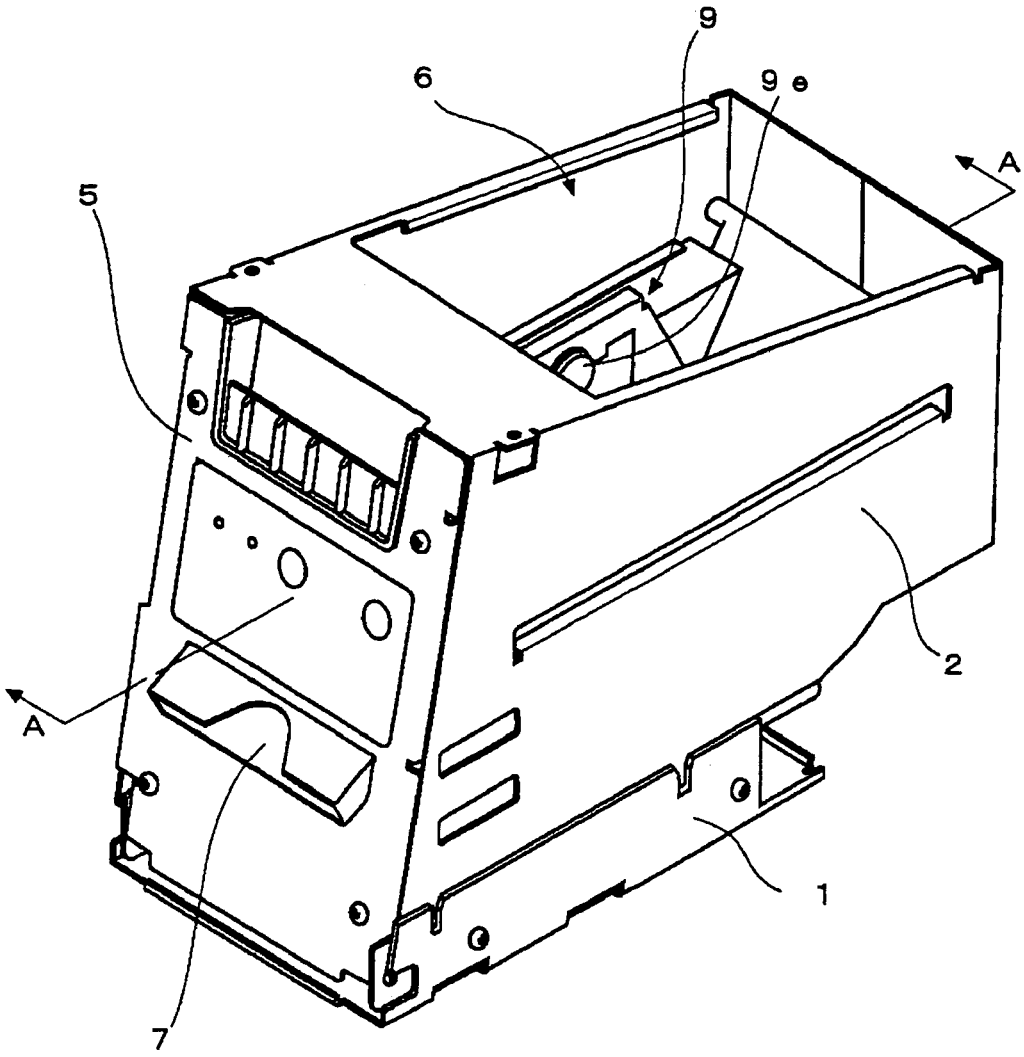
FIG. 1 is a perspective view showing an appearance of a printer according to an embodiment of the invention.

The configuration of a printer according to an embodiment of the present invention will now be described with reference to FIGS. 1 and 2.

A lower frame 1 and an upper frame 2 form a printer case that encloses the whole surfaces of the printer except parts of the front and top surfaces. A control circuit unit 8 is mounted in the lower frame 1. The control circuit unit 8 is provided with a DIP switch 8*a* as an externally accessible adjusting element for changing the operation mode. On the other hand, a paper holder unit 9 is incorporated in the upper frame 2. The front surface of the upper frame 2 is closed by a front panel 5 that is swingably mounted on pivots 1*a*.

A print unit 10 and a paper cutting unit 11 are mounted on the inner surface of the front panel 5. The print unit 10 is mounted so that its side on which an unused printing paper 13 (mentioned later) is inserted faces obliquely upward and that its side on which the printed paper 13 is discharged faces obliquely downward. The paper cutting unit 11 is mounted so that its side on which the printed paper 13 is inserted is located near the side of the print unit 10 on which the paper 13 is discharged and that its side on which the paper 13 is discharged faces obliquely downward. Further, a paper exit 7 is provided so that its paper insertion side is located near the side of the paper cutting unit 11 on which the paper is discharged. Thus, the printing paper 13 having passed through the print unit 10 and the paper cutting unit 11 is discharged to the outside of the front panel 5.

A base plate 3 is mounted between the lower and upper frames 1 and 2. A base plate opening 3*a* is formed in that part of the base plate 3 which faces the DIP switch 8*a*. On the other hand, a slide plate 4 is mounted on the top surface of the base plate 3 so as to be longitudinally movable with respect to the base plate 3.

A slide plate opening 4*a* is formed in the slide plate 4. It is situated in a position such that it faces the DIP switch 8*a* when the slide plate 4 is moved to a specific position. Further, first and second slide plate engaging pins 4*b* and 4*c* are fixed to the front and rear ends, respectively, of the slide plate 4. A paper holder unit 9 is mounted on the top surface of the slide plate 4 so as to be longitudinally movable with respect to the slide plate 4.

The paper holder unit 9 is in the form of a cup that is defined by a paper holder bottom plate 9*a*, which forms bottom, front, and rear walls, and paper holder side plates 9*b*, which form opposite side walls. First paper supporting shafts 9*e* are mounted on the side plates 9*b*, individually. A paper holder bottom opening 9*c* is formed in the bottom plate 9*a*. It is situated in a position such that it faces the DIP switch 8*a* when the paper holder unit 9 is moved on the slide plate 4 to a specific position.

The paper holder unit 9 and the front panel 5 are coupled to each other by a link 12. If the front panel 5 is opened, the holder unit 9 moves forward. If the former is closed, the latter moves backward.

Operation for opening the front panel 5 of the printer shown in FIG. 2 will now be described with reference to FIG. 3.

In loading the printing paper 13 into the paper holder unit 9, the front panel 5 is swung open around the pivots 1*a* with its upper end portion held by hand. When the front panel 5 is opened at an angle θ2 shown in FIG. 3, the paper holder unit 9 that is coupled to the front panel 5 by the link 12 moves forward to the position shown in FIG. 3.

A first operation for loading the printing paper 13 into the paper holder unit 9 of the printer shown in FIG. 3 will now be described with reference to FIG. 4.

If the front panel 5 is fully opened, a part of the paper holder unit 9 is caused to project forward from the upper frame 2 by the action of the link 12. Thereupon, the printing paper 13 can be put into the holder unit 9 as indicated by arrow b and set on the first paper supporting shafts 9*e*.

If the front panel 5 is fully opened, moreover, the print unit 10 moves further forward, so that a paper end portion 13*a* of the printing paper 13 on the first paper supporting shafts 9*e* can be easily inserted into the print unit 10, as indicated by arrow c.

Operation for closing the front panel 5 of the printer shown in FIG. 4 will now be described with reference to FIG. 5.

Figure 5:
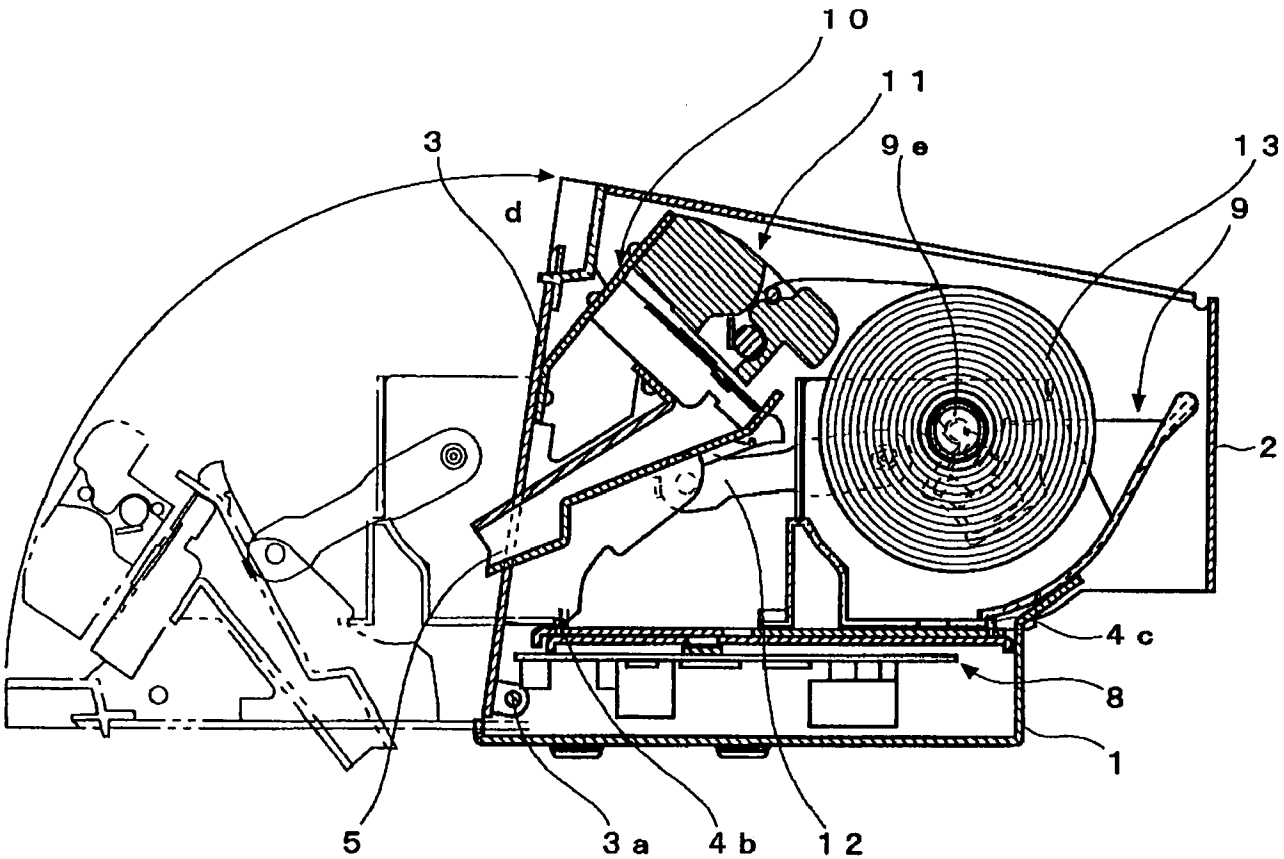
FIG. 5 is a view illustrating the printer of FIG. 4 with its front panel closed.

If the front panel 5 is swung in the direction indicated by arrow d with its upper end portion held by hand, the paper holder unit 9 that is coupled to the front panel 5 by the link 12 moves backward to the position shown in FIG. 5.

A second operation for loading the printing paper 13 into the paper holder unit 9 of the printer shown in FIG. 2 will now be described with reference to FIG. 6.

With the front panel 5 kept closed, the printing paper 13 is put into the paper holder unit 9 as indicated by arrow e through a top opening 6 in the upper frame 2 and set on the first paper supporting shafts 9*e*. Then, the end portion 13*a* of the paper 13 on the shafts 9*e* is inserted into the print unit 10, as indicated by arrow f.

Operation for taking out the paper end portion 13*a* of the printing paper 13 in the printer shown in FIGS. 5 and 6 through the paper exit 7 will now be described with reference to FIG. 7.

Figure 6:
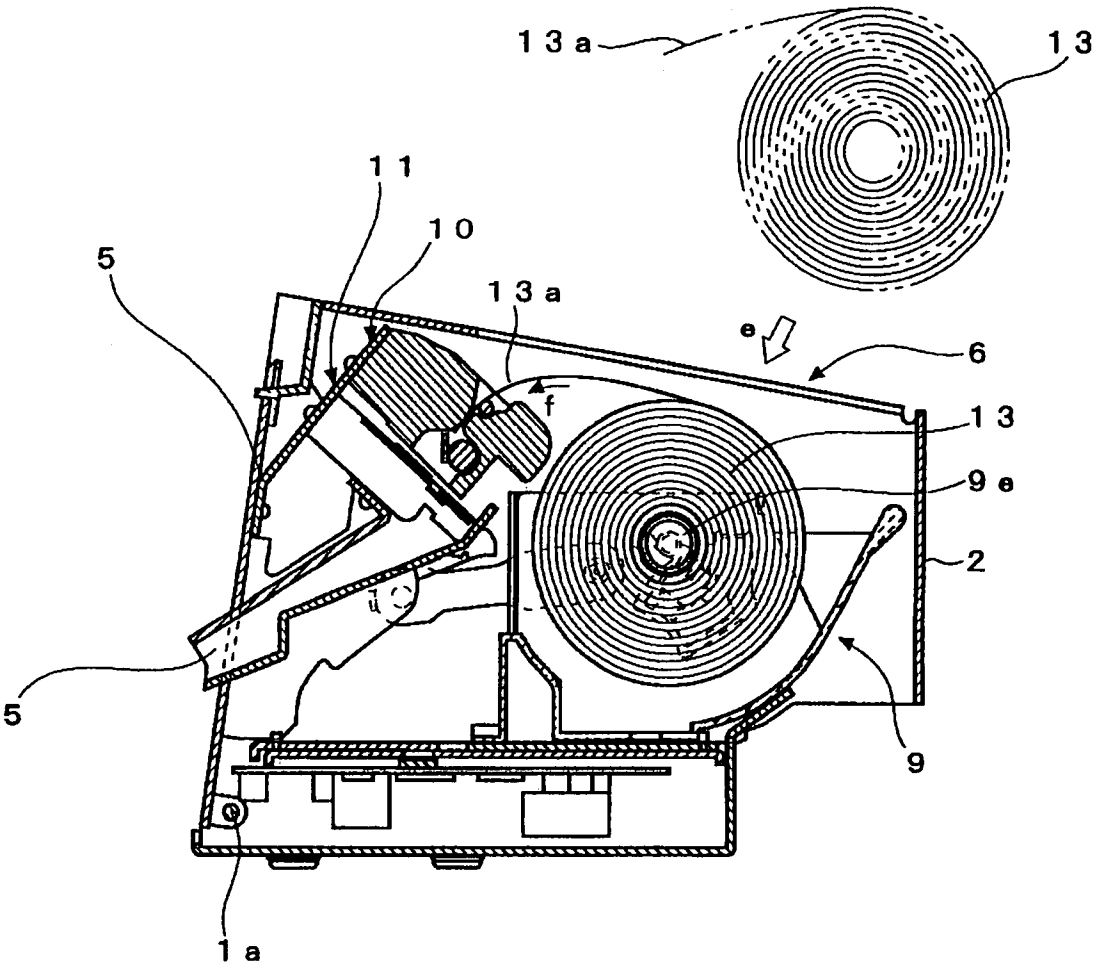
FIG. 6 is a view illustrating the way the printing paper is loaded into the paper holder unit of the printer of FIG. 2.
Figure 7:
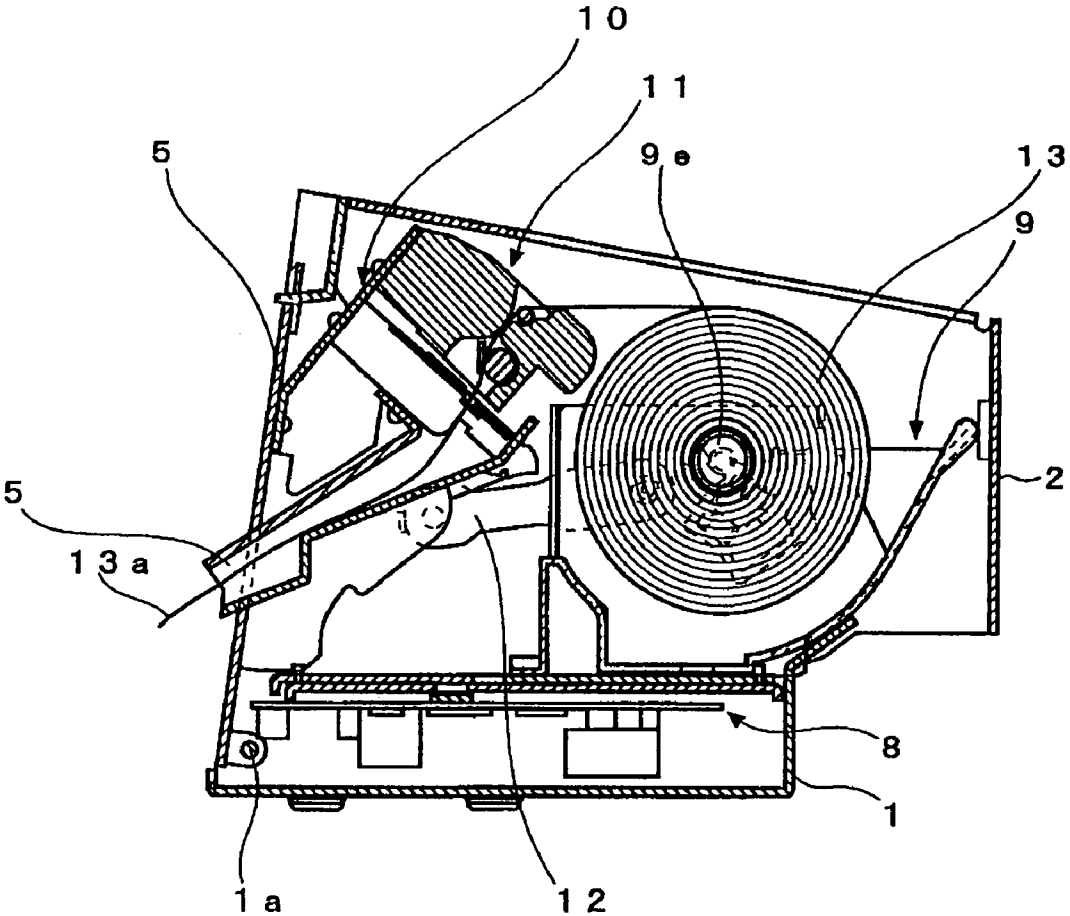
FIG. 7 is a view showing a state in which the printing paper set in the paper holder unit of the printer is further transported from the state of FIG. 6 so that its end portion projects from a paper exit.

If the paper end portion 13*a* of the printing paper 13 loaded on the first paper supporting shafts 9*e* is inserted into the print unit 10 in the manner shown in FIG. 5 or 6, a sensor (not shown) attached to the print unit 10 detects the end portion 13*a* and sends a signal to the control circuit unit 8. Thereupon, the control circuit unit 8 drives paper feeding means (not shown) to feed the printing paper 13 in response to this signal, thereby moving the paper 13 to a position in which the paper end portion 13*a* slightly projects from the paper exit 7.

Figure 8:
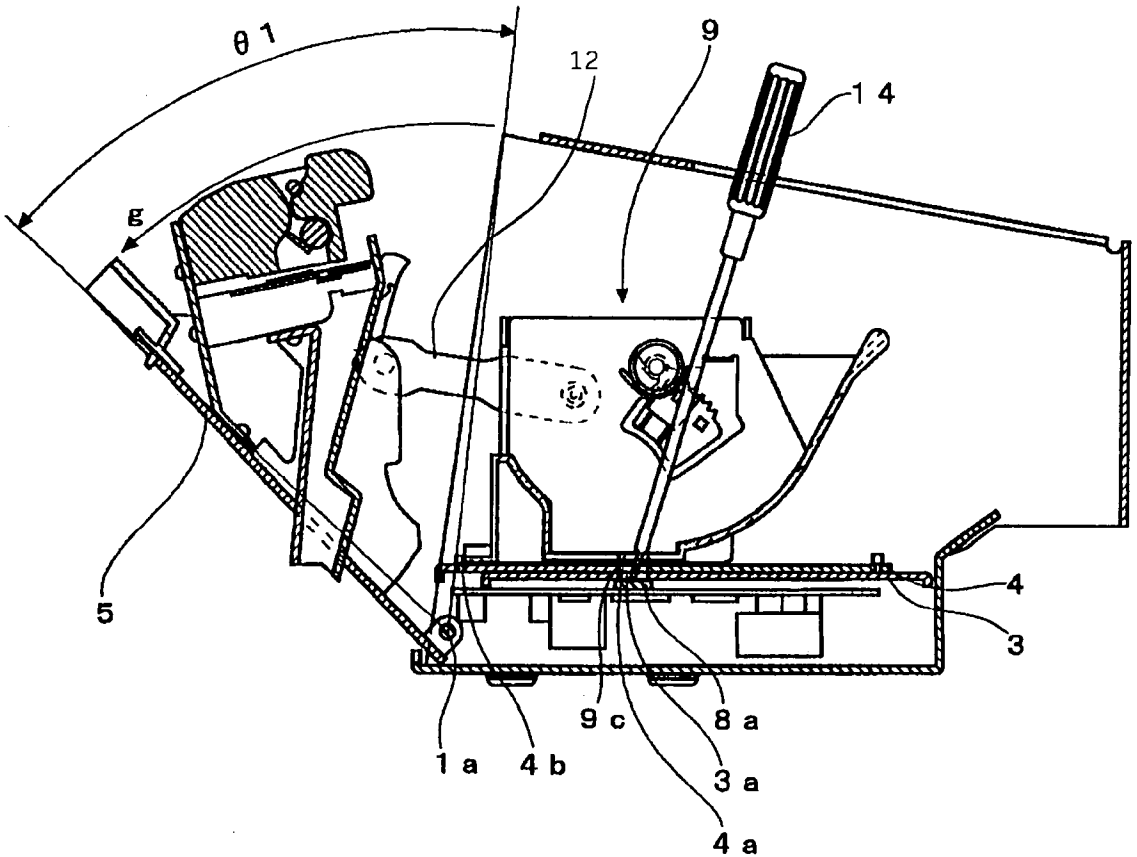
FIG. 8 is a view showing a state in which a DIP switch is operated with a tool passed through respective openings of a base plate, slide plate, and bottom plate of the paper holder unit with the front panel opened halfway.

A state in which the DIP-switch 8*a* on the control circuit unit 8 is operated will now be described with reference to FIG. 8.

Figure 2:
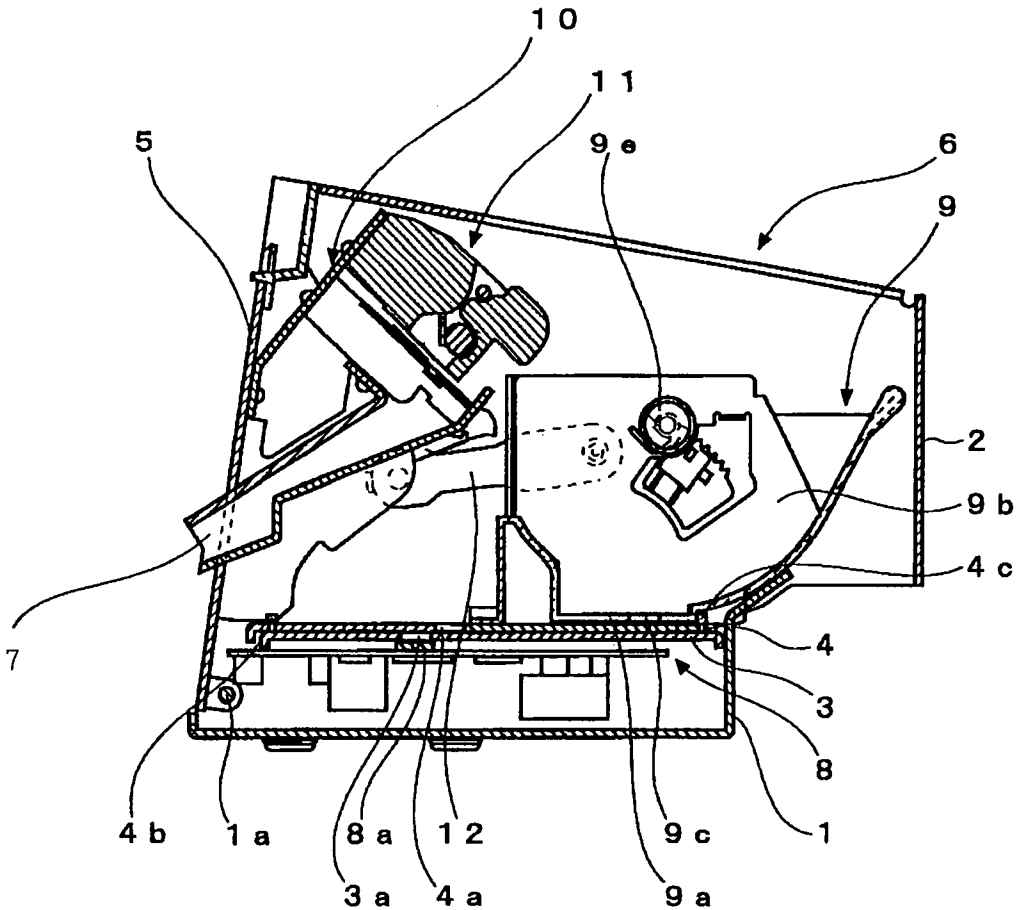
FIG. 2 is a sectional view of the printer taken along line A-A of FIG. 1.

When the front panel 5 is opened at an angle θ1 in the direction indicated by arrow g from the state of FIG. 2, the paper holder unit 9 that is coupled to the front panel 5 by the link 12 moves forward. Since the front end portion of the holder unit 9 is in engagement with the first slide plate engaging pin 4*b*, the slide plate 4 also moves forward as the holder unit 9 moves forward.

As the slide plate 4 moves forward, the slide plate opening 4*a* in the slide plate 4 and the paper holder bottom opening 9*c* in the bottom plate 9*a* of the paper holder unit 9 are aligned with each other in a position where they face the DIP switch 8*a*. Thus, in the position opposite the DIP switch 8*a*, the base plate opening 3*a*, slide plate opening 4*a*, and paper holder bottom opening 9*c* face one another. Therefore, the DIP switch 8*a* can be operated through the openings 3*a*, 4*a* and 9*c* by using a first tool 14, for example.

Figure 3:
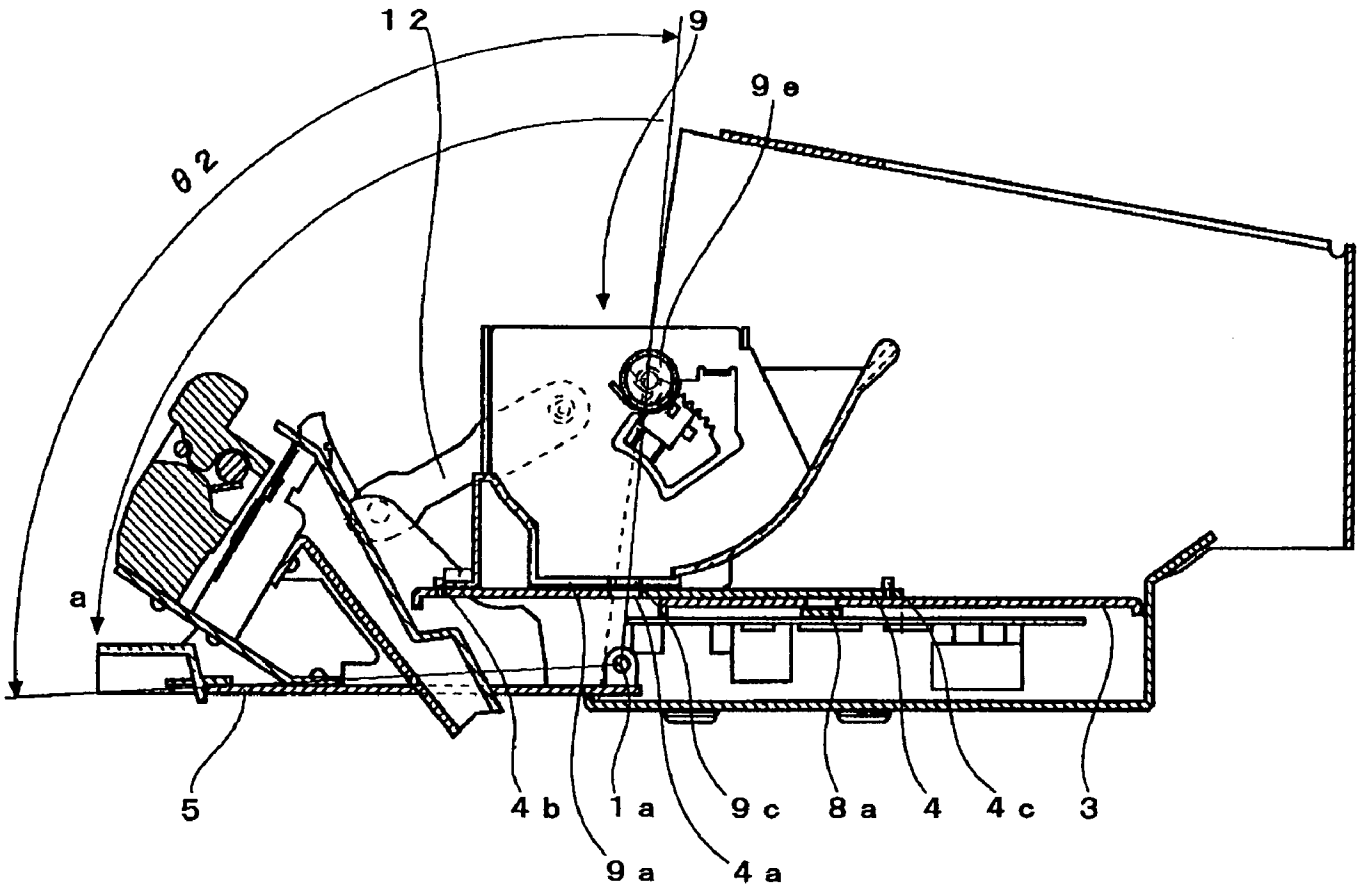
FIG. 3 is a view illustrating the printer of FIG. 2 with its front panel open.
Figure 4:
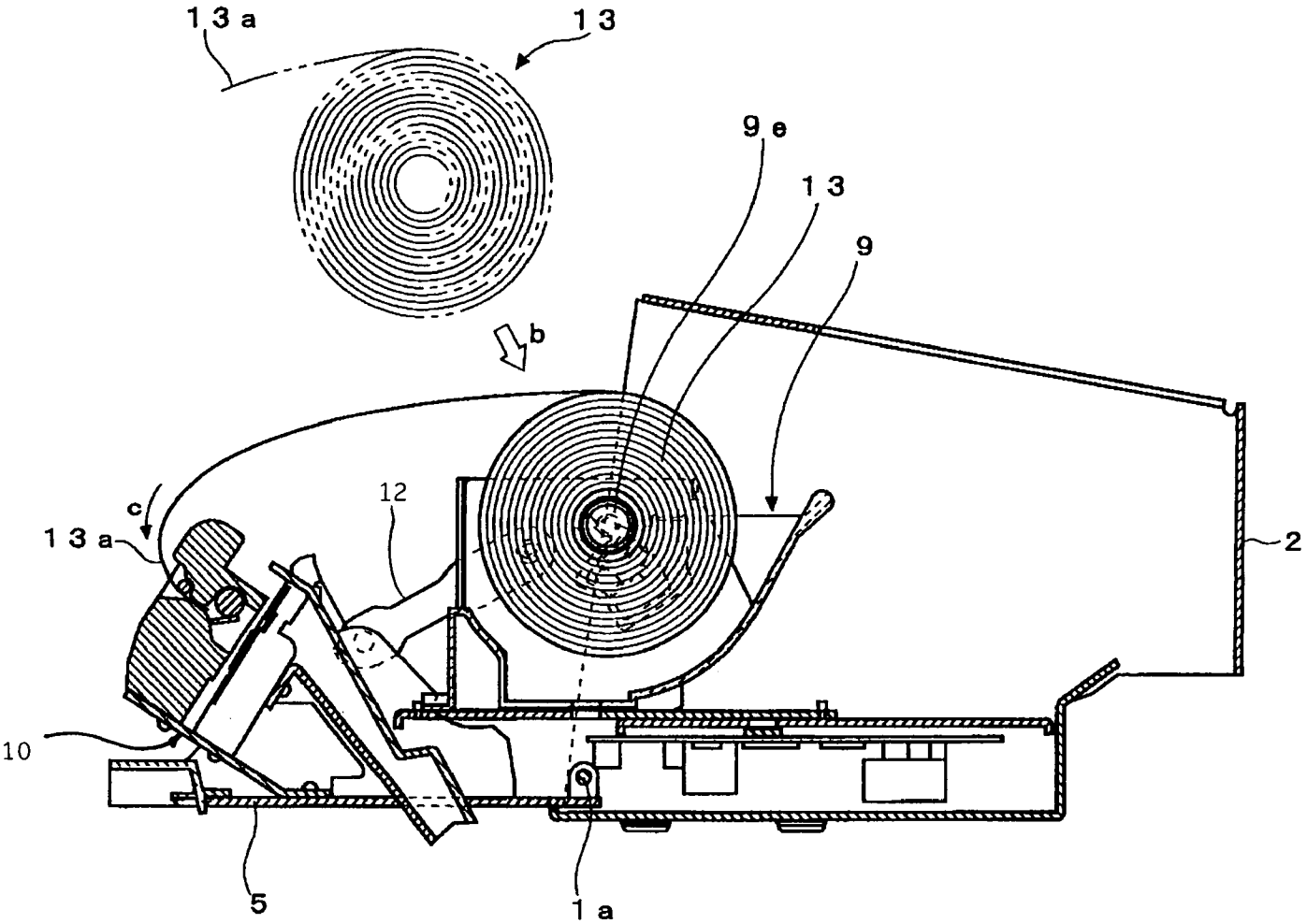
FIG. 4 is a view illustrating the way a printing paper is loaded into a paper holder unit of the printer of FIG. 3.

Thus, when the paper holder unit 9 is in a steady-state position shown in FIG. 2 with the front panel 5 closed and when it is in the state of FIG. 3 where it projects forward with the front panel 5 open, the slide plate opening 4*a* or the paper holder bottom plate 9*a* covers the base plate opening 3*a* that faces the DIP switch 8*a*, so that the switch 8*a* cannot be externally affected by any foreign matter.

Figure 9:
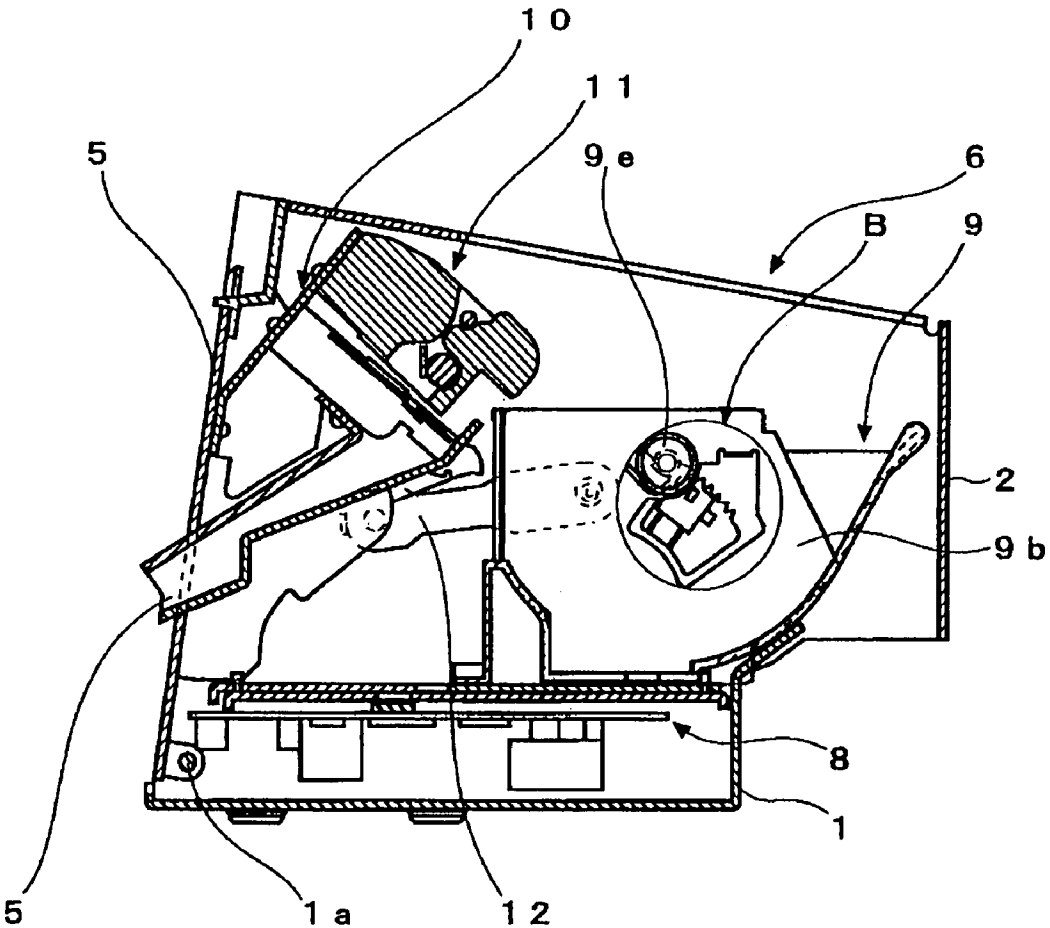
FIG. 9 is a view showing a state in which a first paper supporting shaft is mounted on a side plate of the paper holder unit of the printer of FIG. 2.
Figure 10:
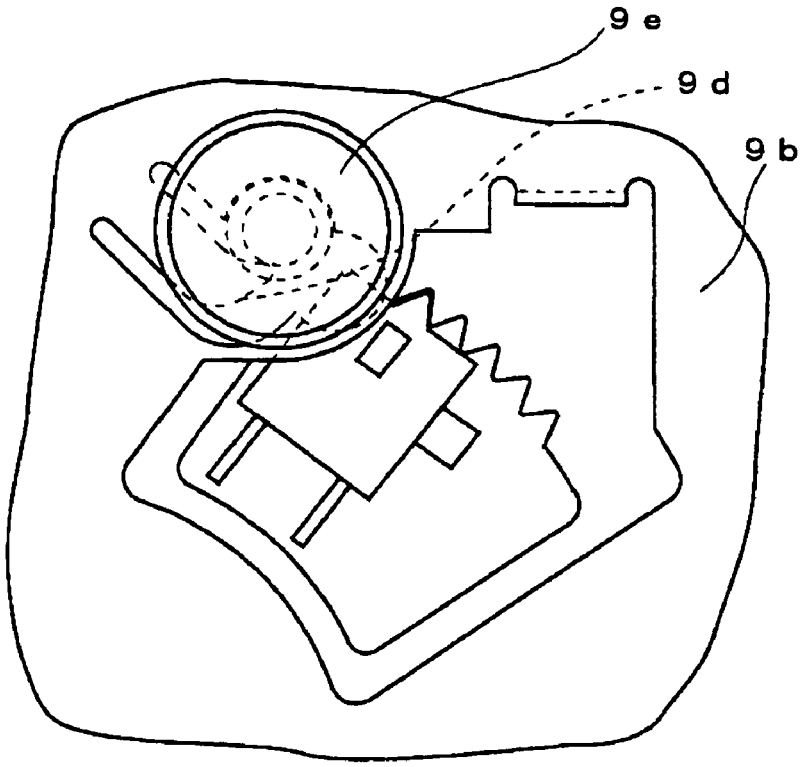
FIG. 10 is an enlarged detailed view showing a state in which the first paper supporting shaft indicated by symbol B in FIG. 9 is mounted on the paper holder side plate.

A state in which each first paper supporting shaft 9*e* is mounted on each side plate 9*b* of the paper holder unit 9 will now be described with reference to FIG. 9 and its enlarged views of FIGS. 10 and 11.

Figure 11:
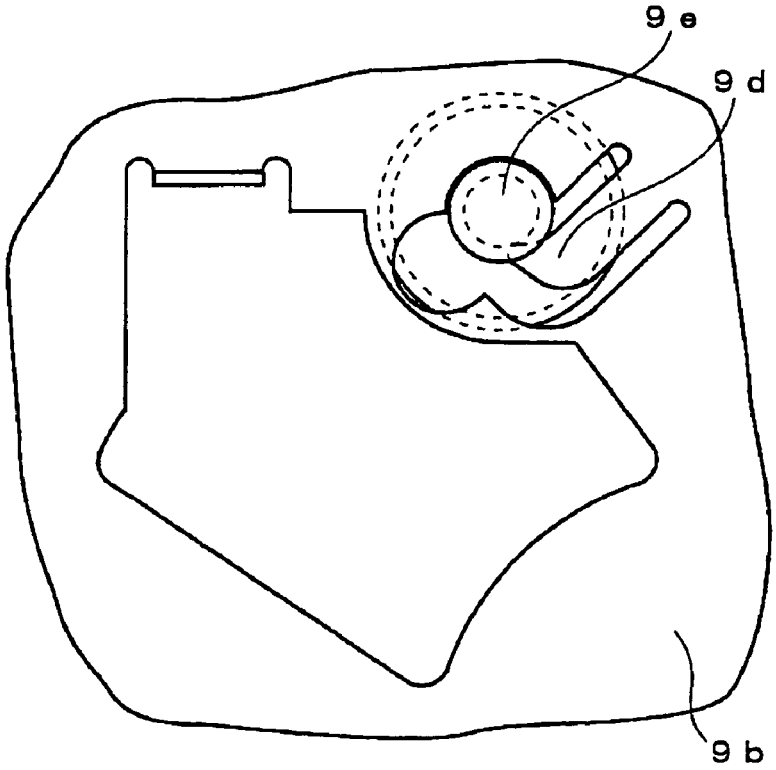
FIG. 11 is a rear view showing a state in which the first paper supporting shaft shown in FIG. 10 is mounted on the paper holder side plate.

As shown in FIG. 11, each first paper supporting shaft 9*e* is retained by a paper supporting shaft locking claw 9*d* that is formed by cutting a part of each paper holder side plate 9*b*.

The way each first paper supporting shaft 9*e* provided on each paper holder side plate 9*b* is removed will now be described with reference to FIGS. 12A and 12B.

If the inside diameter of a bobbin for the printing paper 13 to be set is D1, the first paper supporting shafts 9*e* are used in the aforesaid manner. If the inside diameter of the bobbin is not D1, however, the supporting shafts 9*e* are removed and replaced with any other supporting shafts that match the bobbin diameter for the printing paper 13.

Figure 12A:
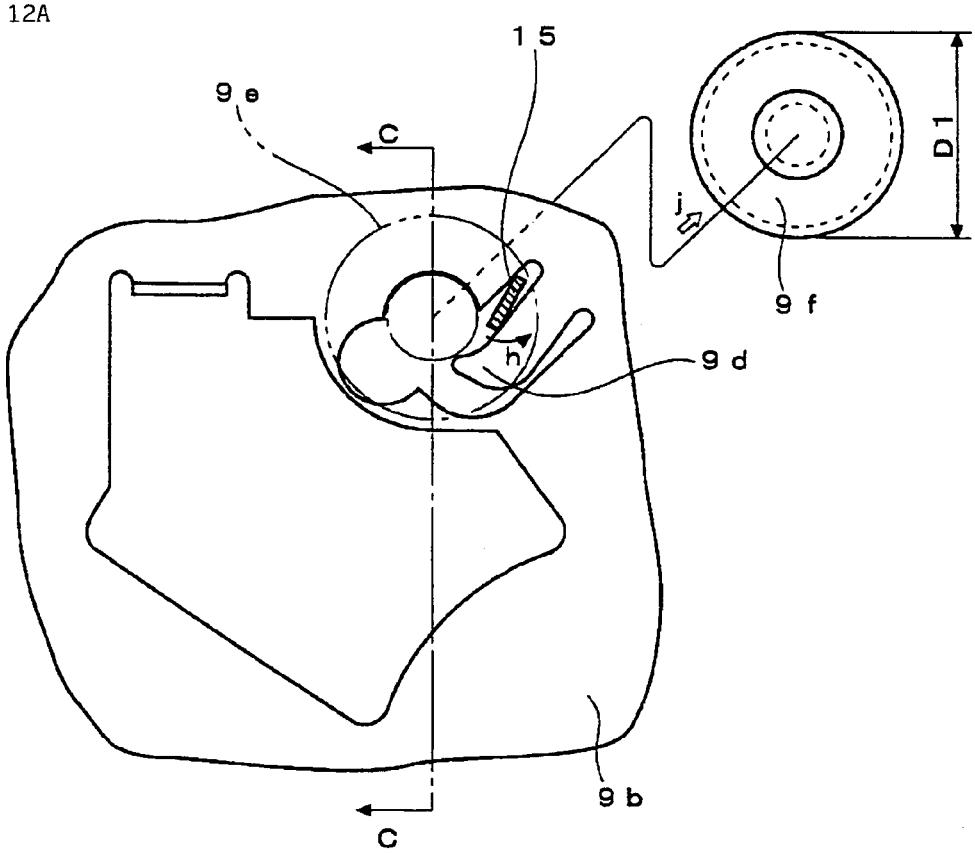
FIG. 12A is a view illustrating the way the first paper supporting shaft shown in FIG. 11 is removed from the paper holder side plate.
Figure 12B:
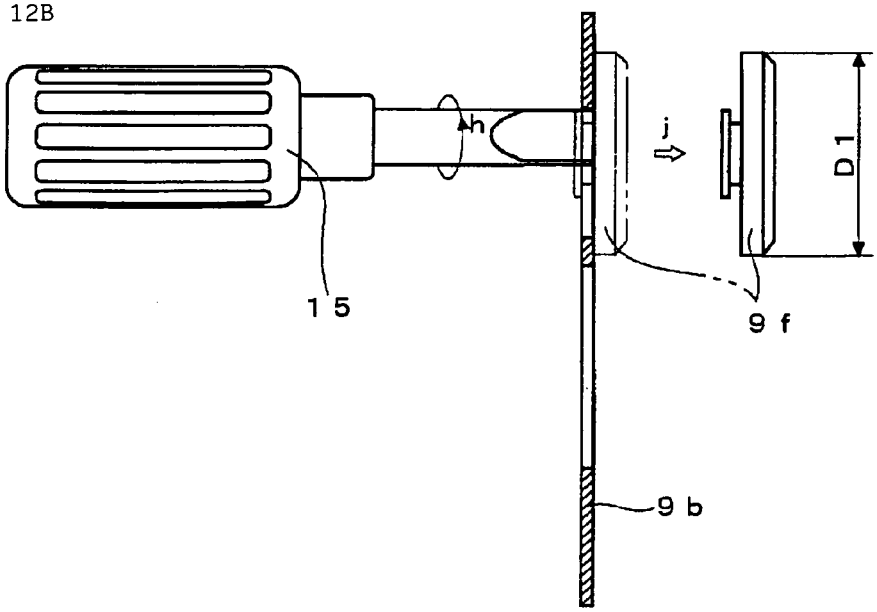
FIG. 12B is a sectional view taken along line C-C of FIG. 12A.

In removing each first paper supporting shaft 9*e*, the paper supporting shaft locking claw 9*d* is deformed in the direction indicated by arrow h in FIG. 12A by means of a second tool 15, for example, and the supporting shaft 9*e* is disengaged from the paper holder side plate 9*b* in the direction indicated by arrow j (axial direction).

The way a second paper supporting shaft 9*f* is mounted on the paper holder side plate 9*b* will now be described with reference to FIGS. 13A and 13B.

Figure 13A:
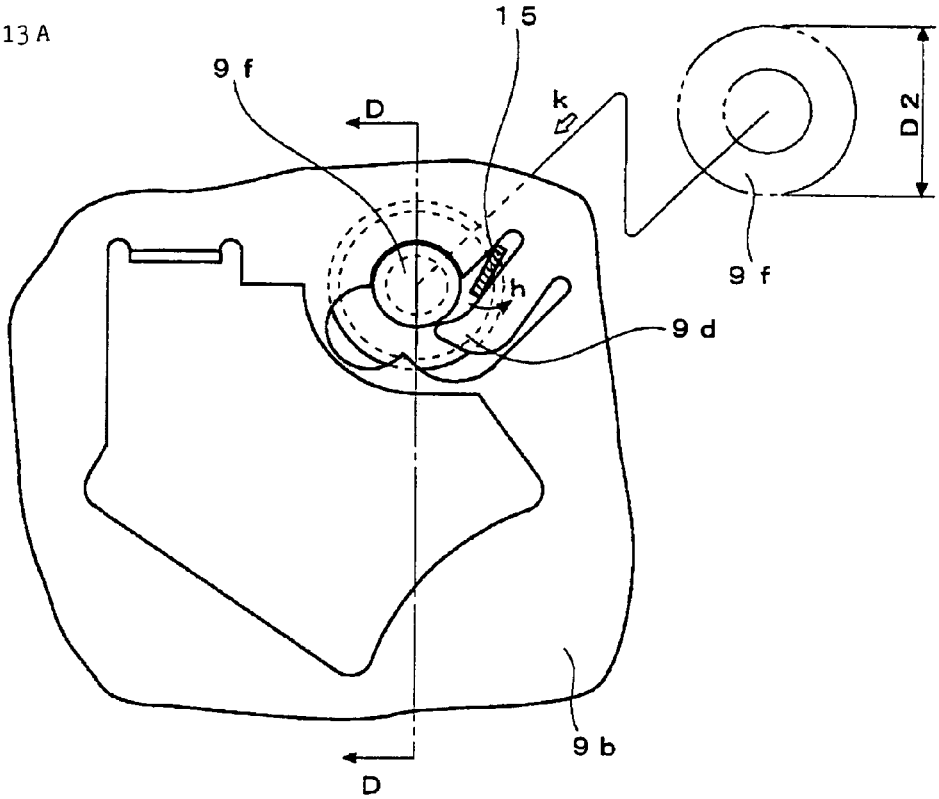
FIG. 13A is a view illustrating the way the first paper supporting shaft of FIG. 12A is removed from the paper holder side plate and a second paper supporting shaft is mounted.
Figure 13B:
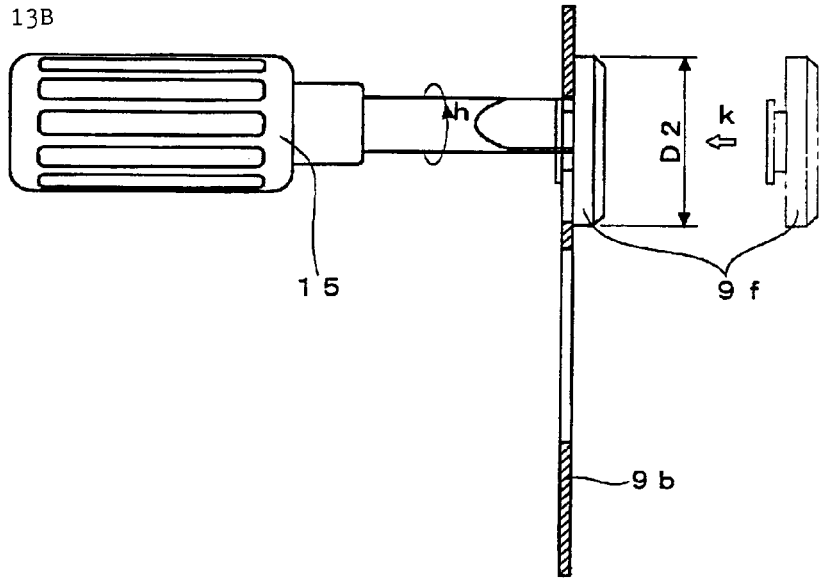
FIG. 13B is a sectional view taken along line D-D of FIG. 13A.
Figure 14:
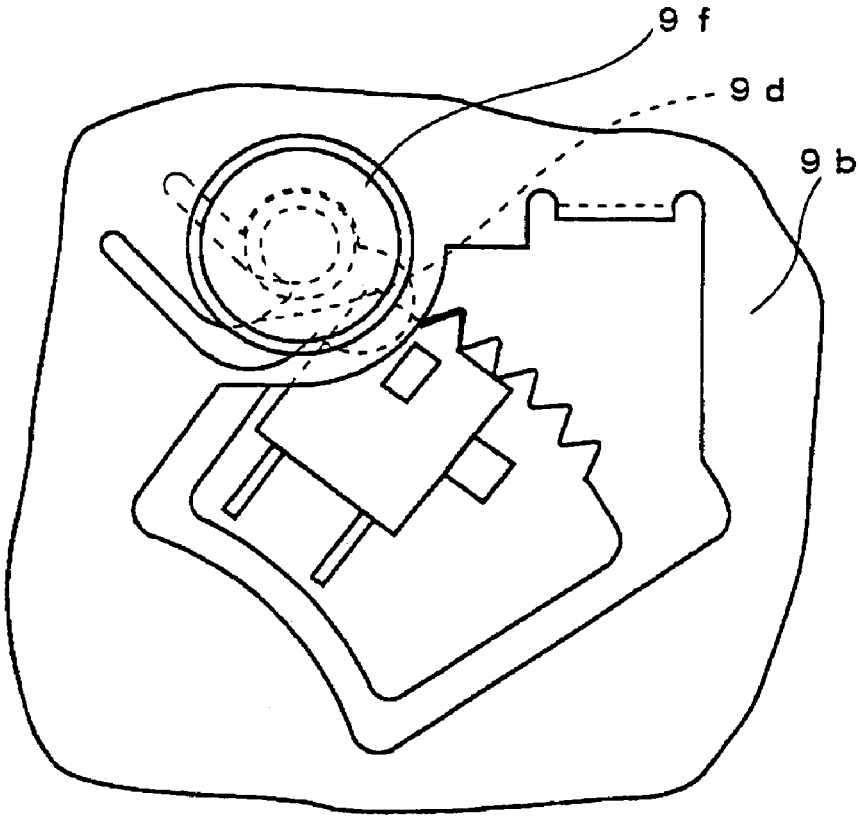
FIG. 14 is a detailed view showing a state in which the second paper supporting shaft is mounted, in place of the first paper supporting shaft of FIG. 12, on the paper holder side plate.
Figure 15:
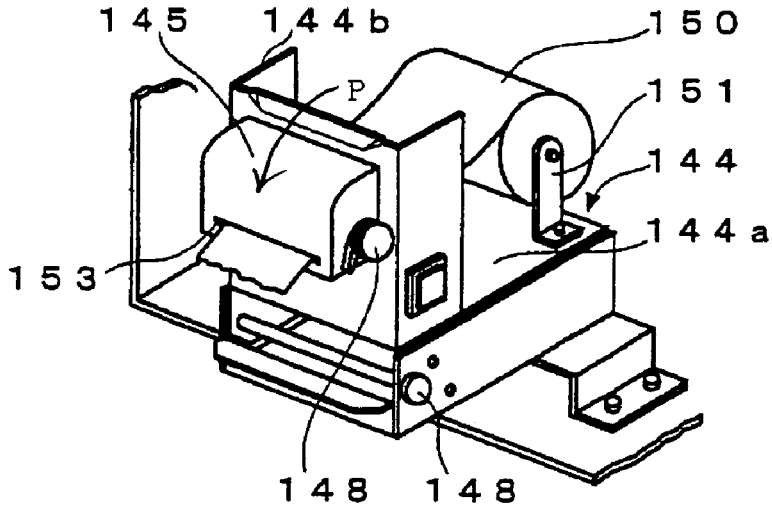
FIG. 15 is a perspective view showing a stable state of a conventional printer.
Figure 16:
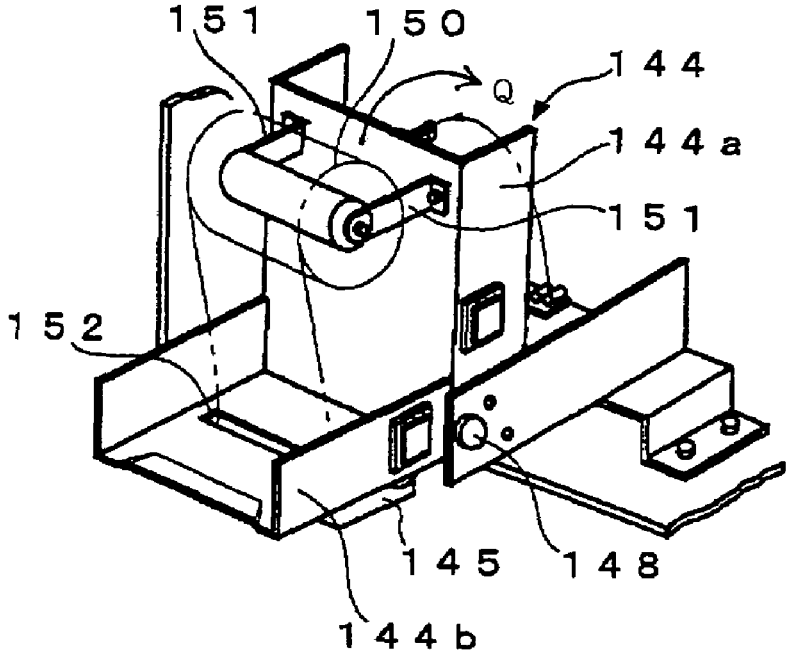
FIG. 16 is a perspective view showing a state in which a printing paper for the printer shown in FIG. 15 is replaced with a new one.

As in the aforesaid case of the removal of the first paper supporting shaft 9*e*, the paper supporting shaft locking claw 9*d* is deformed in the direction indicated by arrow h in FIG. 13A by means of the second tool 15, and the supporting shaft 9*f* is attached to the paper holder side plate 9*b* in the direction indicated by arrow k (axial direction).

What is claimed is:

1. A printer for printing a rolled printing paper, comprising:

a frame having a top opening;

a front panel swingably attached to a front surface of the frame;

a print unit for printing the rolled printing paper, the print unit being attached to a rear surface of the front panel of the frame;

a paper cutting unit for cutting a printed paper, the paper cutting unit being attached to the rear surface of the front panel; and a paper holder unit for holding the rolled printing paper, the paper holder unit being mounted for longitudinal movement in the frame and coupled to the front panel by a link, the paper holder unit being formed of a bottom plate and side plates so as to provide a top opening whereby the paper holding unit is configured to be loaded with the printing paper at the top opening, and the paper holder unit being configured to move longitudinally toward the front of the frame without changing its position in a vertical direction as the front panel is opened.

2. The printer according to claim 1, wherein the printing paper is loaded into the paper holder unit when the front panel is fully opened.

3. The printer according to claim 1, wherein the front panel is provided with a paper exit through which the printed paper is discharged, and a paper end portion of the printing paper is delivered to the paper exit through the paper cutting unit as the paper end portion is inserted into the print unit from above with the front panel open.

4. The printer according to claim 1, wherein the paper holder unit is configured to be mounted with a plurality of paper supporting shafts having different diameters.

5. The printer according to claim 4, wherein the side plates of the paper holder unit are formed individually having paper supporting shaft locking claws, and the paper supporting shafts are configured to be attached and detached by deforming the locking claws.

6. A printer for printing and discharging a rolled printing paper, comprising:

a frame having a top opening;

a front panel swingably attached to a front surface of the frame and having a paper exit through which the printed paper is discharged;

a print unit attached to the rear surface of the front panel and configured to print the printing paper;

a paper cutting unit attached to the rear surface of the front panel and configured to cut the printed paper;

a paper holder unit for holding the printing paper, the paper holder unit being mounted for longitudinal movement in the frame and coupled to the front panel by a link, the paper holder unit being formed of a bottom plate and side plates so as to provide a top opening whereby the paper holding unit is configured to be loaded with the printing paper at the top opening, and the paper holder unit being configured to move longitudinally toward the front of the frame without changing its position in a vertical direction as the front panel is opened; and a control circuit unit for controlling the print unit and the paper cutting unit, the control circuit unit having an adjusting element configured to be operated through the top opening of the frame when the front panel is opened halfway.

7. The printer according to claim 6, wherein the adjusting element is a DIP switch.

8. A printer for printing and discharging a rolled printing paper, comprising:

a frame having a top opening;

a front panel swingably attached to a front surface of the frame and having a paper exit through which the printed paper is discharged;

a print unit attached to the front panel and configured to print the printing paper;

a paper cutting unit attached to the front panel and configured to cut the printed paper;

a paper holder unit for holding the printing paper, mounted for longitudinal movement in the frame and coupled to the front panel by a link; and a control circuit unit for controlling the print unit and the paper cutting unit, wherein the control circuit unit has an adjusting element configured to be operated through the top opening of the frame when the front panel is opened halfway; and a base plate is fixedly attached to the frame, a slide plate is mounted on the base plate for longitudinal movement with respect to the base plate, and further the paper holder unit is mounted on this slide plate for longitudinal movement with respect to the slide plate;

a base plate opening is formed in the base plate so as to face the adjusting element;

a slide plate opening is formed in the slide plate so that the slide plate opening faces the base plate opening of the base plate when the slide plate moves to reach a predetermined position; and the base plate opening, slide plate opening, and paper holder bottom opening are moved to a position where these openings are aligned with one another, thereby allowing the adjusting element to be operated when the front panel is opened halfway.

* * * * *